US007386225B2

(12) United States Patent
Lin

(10) Patent No.: US 7,386,225 B2
(45) Date of Patent: Jun. 10, 2008

(54) HUMIDIFICATION APPARATUS

(76) Inventor: Cheng Ping Lin, 5th Fl., No. 26, Sec. 3, Ren-ai Rd., Taipei (TW)

( * ) Notice: Subject to any disclaimer, the term of this patent is extended or adjusted under 35 U.S.C. 154(b) by 0 days.

(21) Appl. No.: 11/463,153

(22) Filed: Aug. 8, 2006

(65) Prior Publication Data

US 2008/0050103 A1 Feb. 28, 2008

(51) Int. Cl.
*A61H 33/12* (2006.01)

(52) U.S. Cl. ..... 392/405; 392/386; 392/397

(58) Field of Classification Search ..... None
See application file for complete search history.

(56) References Cited

U.S. PATENT DOCUMENTS 2,140,516 A * 12/1938 Cowan ..... 392/336
2,302,528 A * 11/1942 Conklin ..... 236/44 A
2,388,907 A * 11/1945 De Lancey ..... 431/259
2,443,417 A * 6/1948 Duncan ..... 126/377.1
3,096,817 A * 7/1963 McKenna ..... 165/60
3,219,795 A * 11/1965 Wiseman ..... 392/402
3,809,374 A * 5/1974 Schossow ..... 261/130
5,361,322 A * 11/1994 Glucksman ..... 392/405
5,693,270 A * 12/1997 Moore et al. ..... 264/21
5,761,378 A * 6/1998 Boyle et al. ..... 392/403
5,809,210 A * 9/1998 Moore et al. ..... 392/402
5,855,856 A * 1/1999 Karlson ..... 422/186.11

* cited by examiner

*Primary Examiner*—Thor S Campbell
(74) *Attorney, Agent, or Firm*—Lowe Hauptman Ham & Berner, LLP

(57) ABSTRACT

A humidification apparatus, comprising a container and a set of heating tube; wherein water (liquid) can be introduced from a container to one end of said heating tube, and an steam outlet is provided in another end so that the steams generated by heating liquid (water) flowed out or spurted; said heating tube is an electric film where the external surface of the quartz tube is electrified for heating. Steams will be generated when liquid (water) introduced and reserved in the tube is electrified and heated by the electric film and then boiled. Therefore, it is necessary to heat partial liquid depending on the amount of steamed needed, and thus power saving can be achieved.

12 Claims, 9 Drawing Sheets

HUMIDIFICATION APPARATUS

BACKGROUND OF THE INVENTION

1. Field of the Invention

The present invention relates to a humidification apparatus, particular to a humidification apparatus capable of reducing power consumption by using a quartz heating tube to heat liquid.

2. Description of the Prior Art

Generally, devices for generating steams or vapors dispersed in the air to ensure the air contains a certain degree of humidity are used to increase air humidity and alleviate the uncomfortableness caused by dry air, particular to the relief of symptoms such as cough or dried and rifted nasal septum owing to over dried air.

Conventional devices for generating steams use an oscillator or ultrasonic oscillator provided in a water tank for high-speed oscillation of water molecules to generate steams. However, this only produces cold vapors and is not suitable for the place that requires raising the air temperature.

Conventional humidification apparatus for producing steams that require certain temperature mainly uses a container for water storage and adds a set of electrothermal tube in the container for generating steams by producing electric heat to heat liquid (i.e. water) until boiling. The generated steams are dispersed to the air via a steam pipe, which increases air temperature and humidity. This not only increases humidification but stabilizes air temperature, which is extremely important to medical places or nursing homes for unhealthy elders.

However, using an electrothermal tube to heat and generate steams may cause high power consumption. Moreover, all liquid in the container need to be continuously heated to the boiling point to generate steams, which consumes more power.

Accordingly, the humidification apparatus according to the present invention has been made based on various experiences and techniques of fabricating heating devices to solve the above-mentioned problems occurring in the prior art.

SUMMARY OF THE INVENTION

The major purpose of the present invention is to provide a humidification apparatus, which uses quartz tubes with an electric film covered on their surface as heating tubes to heat liquid (i.e. water) reserved in the tube and generate steams, instead of heating all liquid in the container, so that power consumption can be reduced.

Another purpose of the present invention is to provide a humidification apparatus where quartz heating tubes are disposed vertically in proportion to each other in the internal part of the container, and a connecting tube transfuses liquid (i.e. water) from the bottom of the container, so that water level in the quartz tube is equivalent to that in the container. Therefore, water level is easy to check at any time.

Another purpose of the present invention is to provide a humidification apparatus where a plurality of electrodes are disposed separately in the internal part of quartz heating tubes, and a temperature sensing switch is interspersed between two electrodes. When water level falls and quartz heating tubes are overheated, power supply will be cut off to prevent the quartz tubes from damage.

The detailed application principle, structure, function, and effects of the present invention will be more apparent from the following descriptions taken in conjunction with the accompanying drawings.

DETAILED DESCRIPTION OF THE PREFERRED EMBODIMENTS

Figure 1:
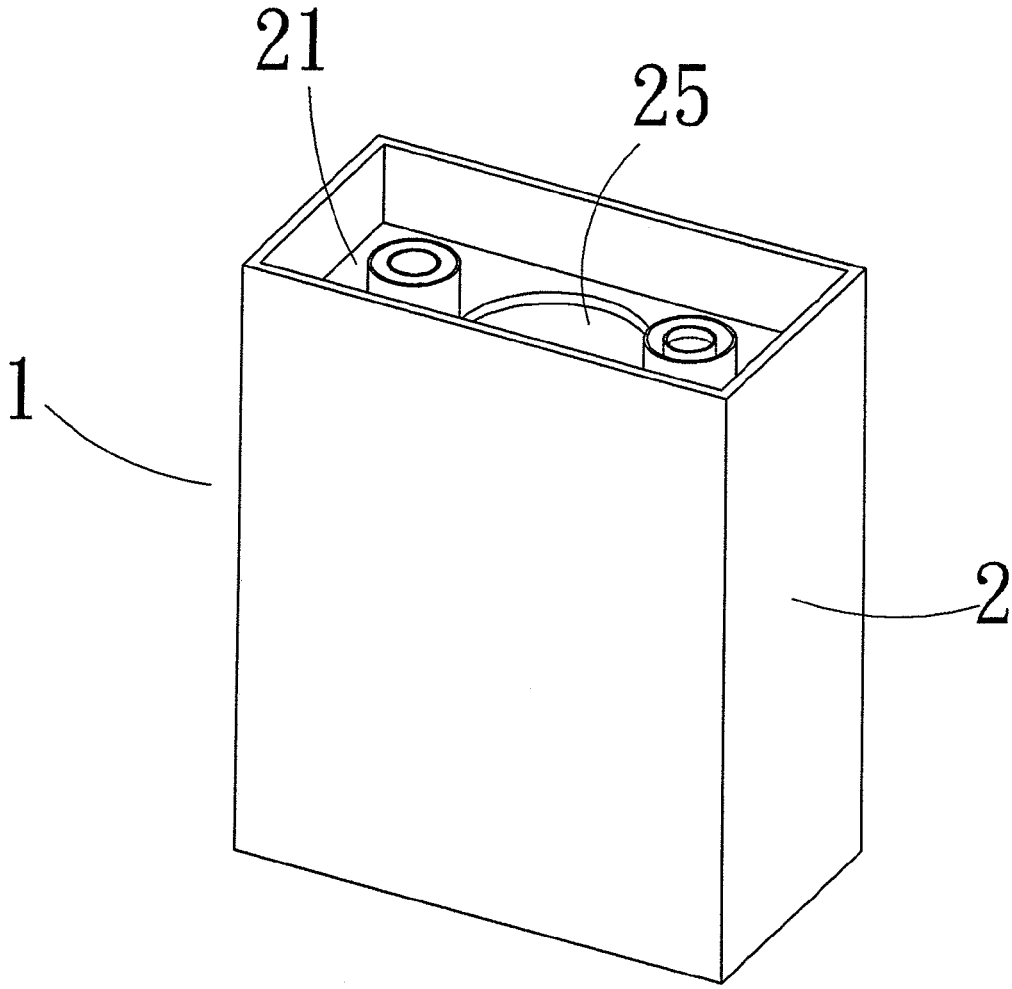
FIG. 1 is a three-dimensional view of the present invention.
Figure 2:
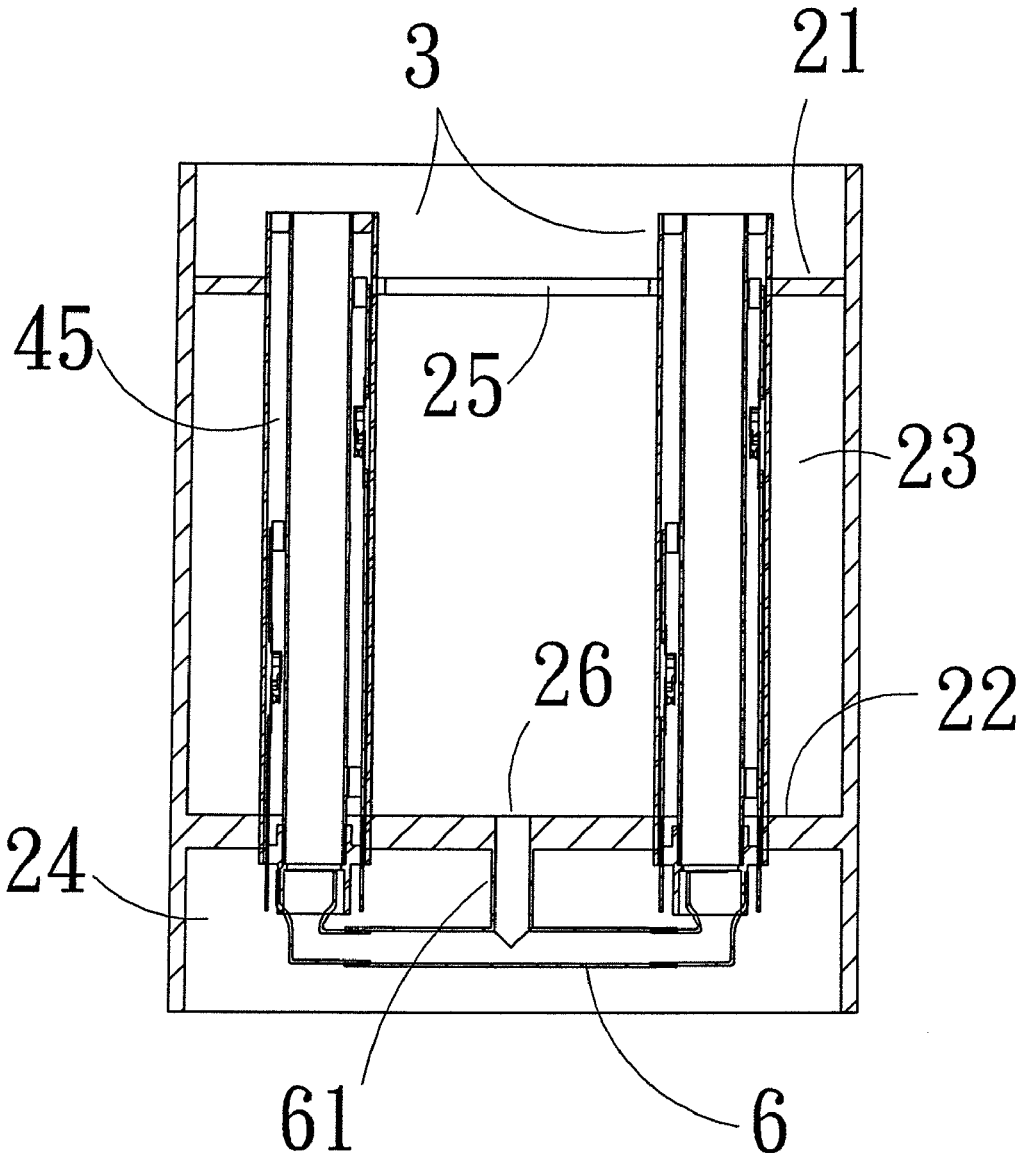
FIG. 2 is a sectional view of the assembly in the present invention.

As shown in FIGS. 1 and 2, the humidification apparatus according to the present invention comprises: a reservoir 2, a set of heating tube 3 and connecting tube 6; where the internal part of said reservoir 2 is divided into container 23 and base space 24 by upper spacer 21 and lower spacer 22. A water injection hole 25 is located in the proper place of the upper spacer 21 for injecting water.

Figure 3:
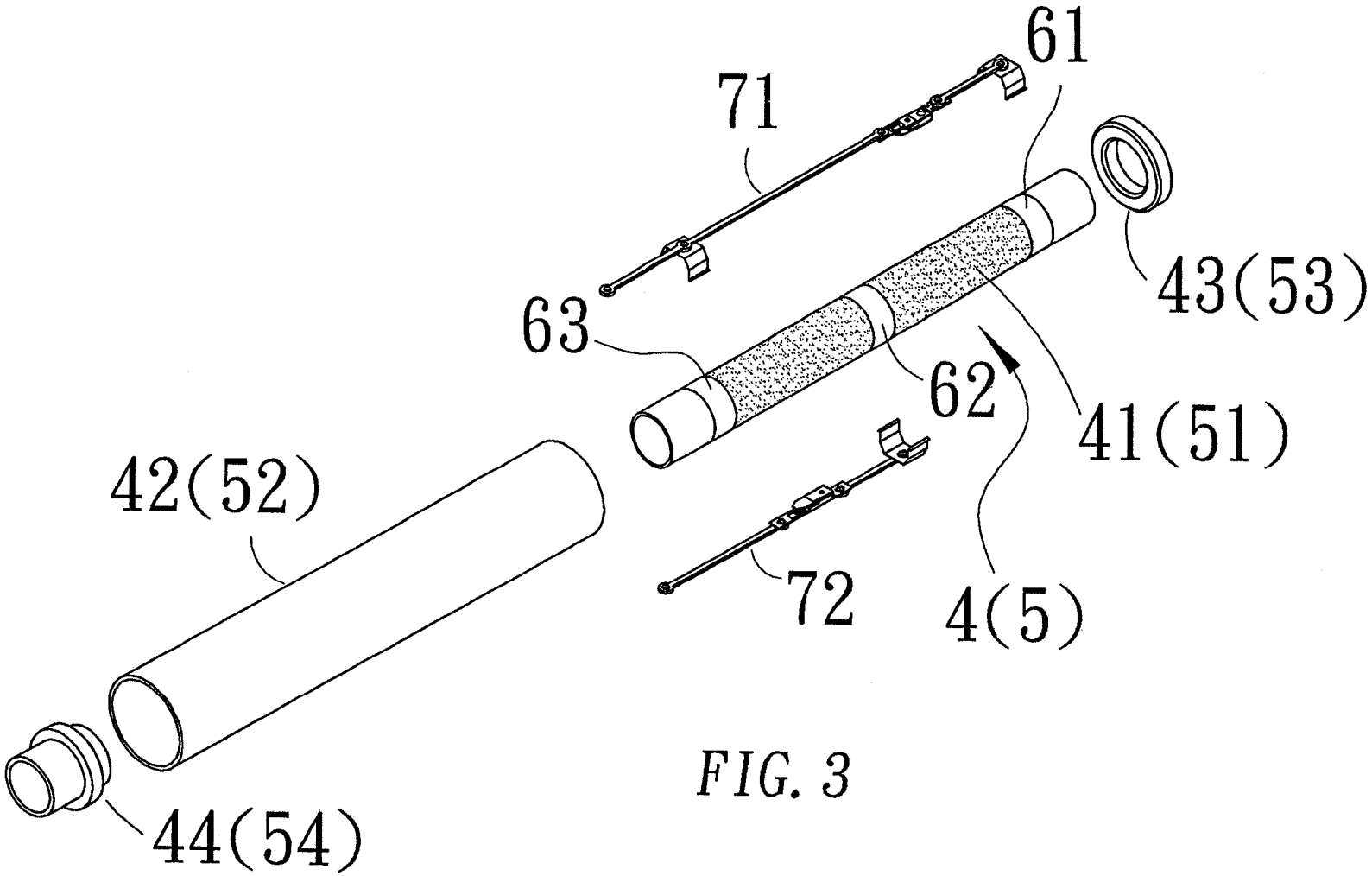
FIG. 3 is a three-dimensional exploded view of the heating tube in the present invention.

Referring to FIG. 3, the heating tube 3 includes two passed-through quartz heating tubes 4, 5 disposed in proportion to each other. The external surface of quartz heating tubes 4, 5 is covered with electric films 41, 51 for giving out heat after electrification. The upper, middle, and lower position of the external surface are provided with first electrode 61, second electrode 62 and third electrode 63 for connecting the power; wherein an upper temperature sensing switch 71 is interspersed between the first electrode 61 and third electrode 63 and a lower temperature sensing switch 7 is interspersed between the first electrode 61 and second electrode 62 for detecting whether the upper and lower part of the quartz tube is overheated respectively. If the quartz tube is overheated, its power supply will be cut off.

The internal part of the quartz heating tubes 4, 5 is covered with insulation sleeves 42, 52 where seal covers 43, 44, 53, 54 are disposed between the insulation sleeves 42, 52 and quartz heating tube 4, 5 to seal and allow for a heat insulation space between the insulation sleeves 42, 52 and quartz heating tubes 4, 5 to prevent the temperature of liquid (water) entered to quartz heating tube 4, 5 from being affected by external liquid (water) so that heating efficiency is reduced.

Connecting tube 6 is a tri-point tube disposed in the base space 24 of the reservoir 2. A conduit 61 in the center of the connecting tube is connected to the outlet on the lower spacer 22 of the container. The two ends of said connecting tube are connected to the water injection hole of the quartz heating tubes 4, 5 respectively.

Figure 4:
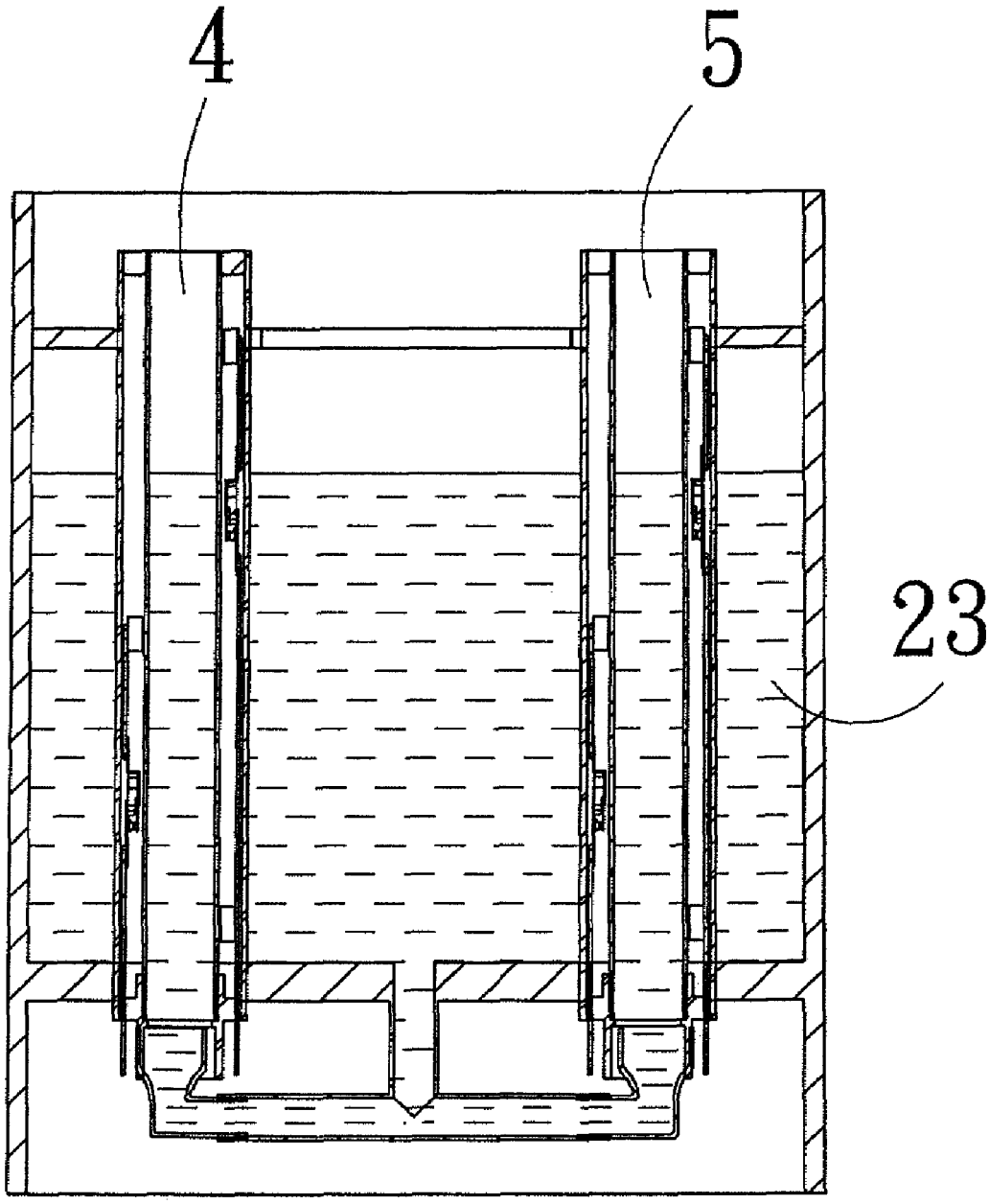
FIG. 4 is a sectional view of an embodiment in the present invention.

Through the structure described above, as shown in FIG. 4, water is injected into the container 23, that is, water is introduced through the connecting tube 6 to the quartz heating tubes 4, 5. For heating the quartz heating tubes 4, 5, electric films are covered on the external surface of quartz heating tubes 4, 5. During heating, said electric films 41, 51 electrified externally to heat liquid (water) reserved in the tube. Since the liquid (water) in the tube is heated comprehensively and the heating area is large, power saving can be achieved.

Figure 5:
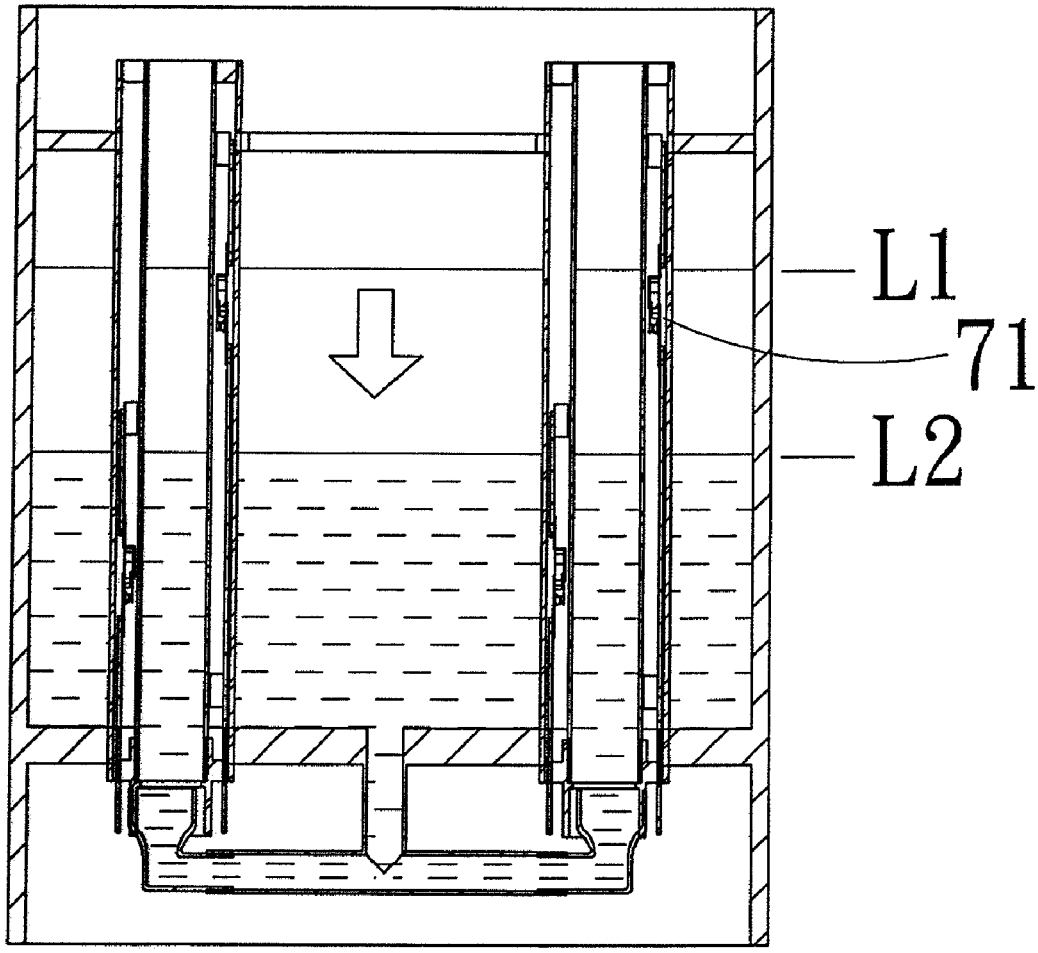
FIG. 5 is a view showing the water level falls.
Figure 6:
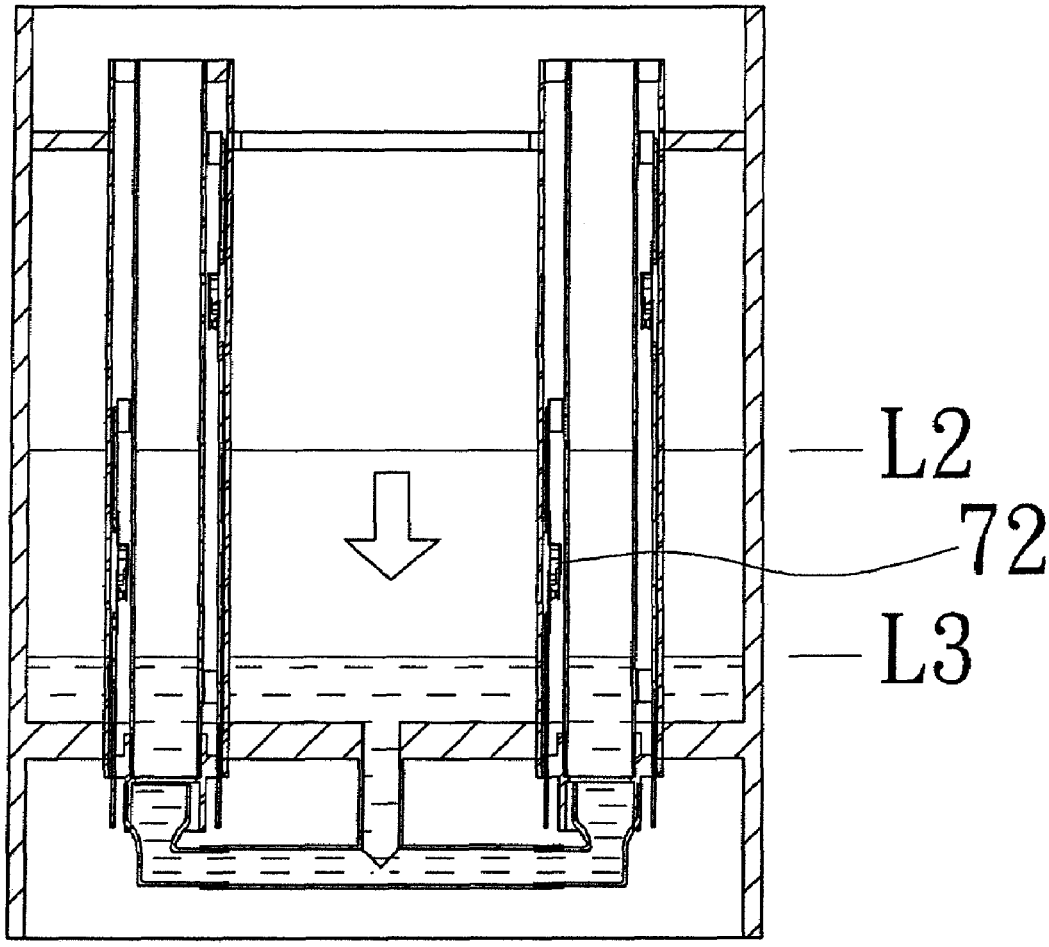
FIG. 6 is another view showing the water level falls.

Moreover, with the setup of upper temperature sensing switch 71 and lower temperature sensing switch 72, as shown in FIG. 5, when water level falls from L1 to L2, the upper part of quartz heating tubes 4, 5 has no water for heating. The quartz heating tubes 4, 5 will be overheated if they have been continuously electrified and heated. Therefore, the power supply of said quartz heating tube will be cut off when the upper temperature sensing switch 71 senses a specific part of quartz tube has high temperature. Similarly, as shown in FIG. 6, when water level falls from L2 to L3, the lower part of quartz heating tubes 4, 5 has no water for heating. Accordingly, power supply of said quartz heating tube will be cut off when the lower temperature sensing switch 72 senses a specific part of quartz tube has high temperature. Therefore, any part of the quartz heating tubes 4, 5 can be protected, which can prevent damage caused by overheating.

Figure 7:
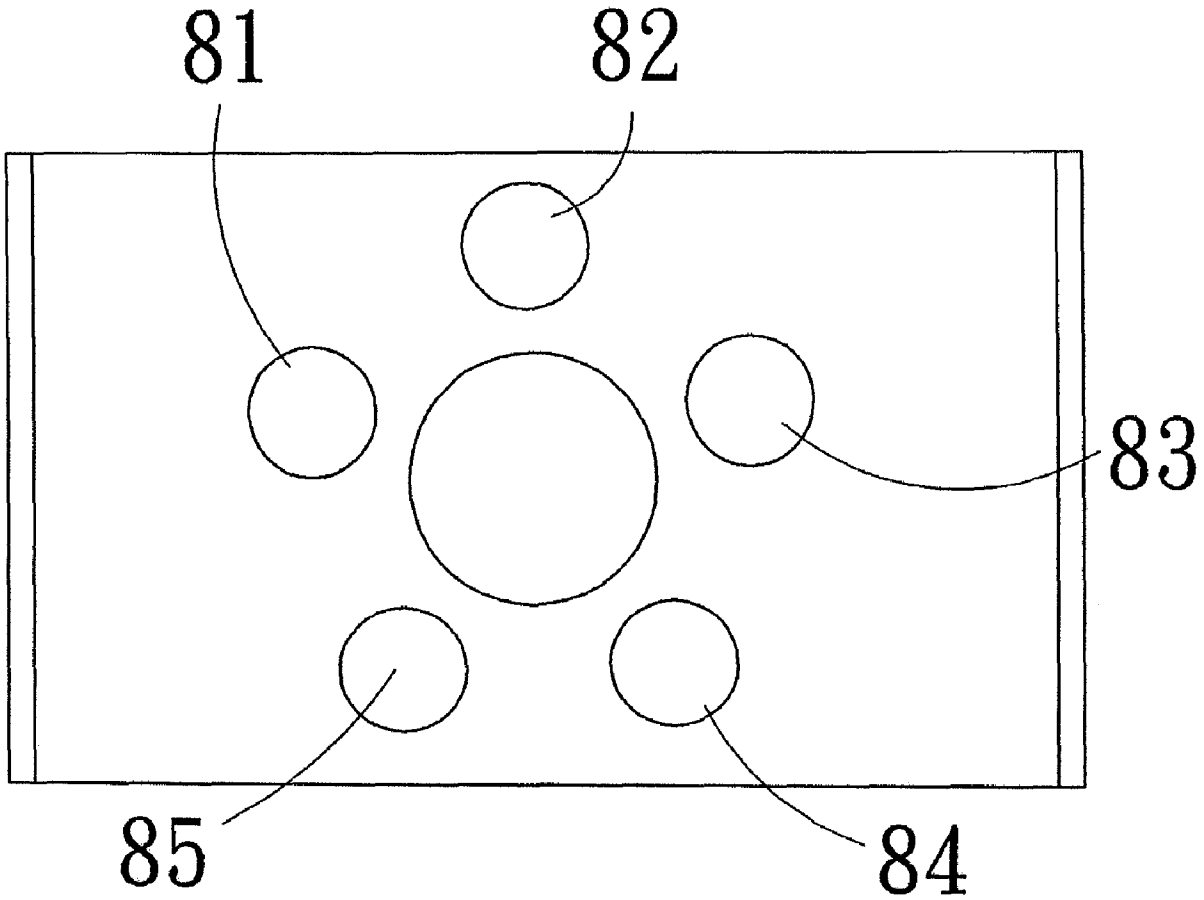
FIG. 7 is a view showing the second embodiment of the present invention.

Referring to another embodiment of the humidification apparatus in the present invention in FIG. 7, the quartz heating tubes used in the present invention can be disposed on both sides of the water injection hole separately as shown in FIG. 2. Moreover, a plurality of quartz heating tubes 81, 82, 83, 84, 85 can be arranged in a circular shape to fit in with the place or facility that requires steams produced over a short period of time.

Figure 8:
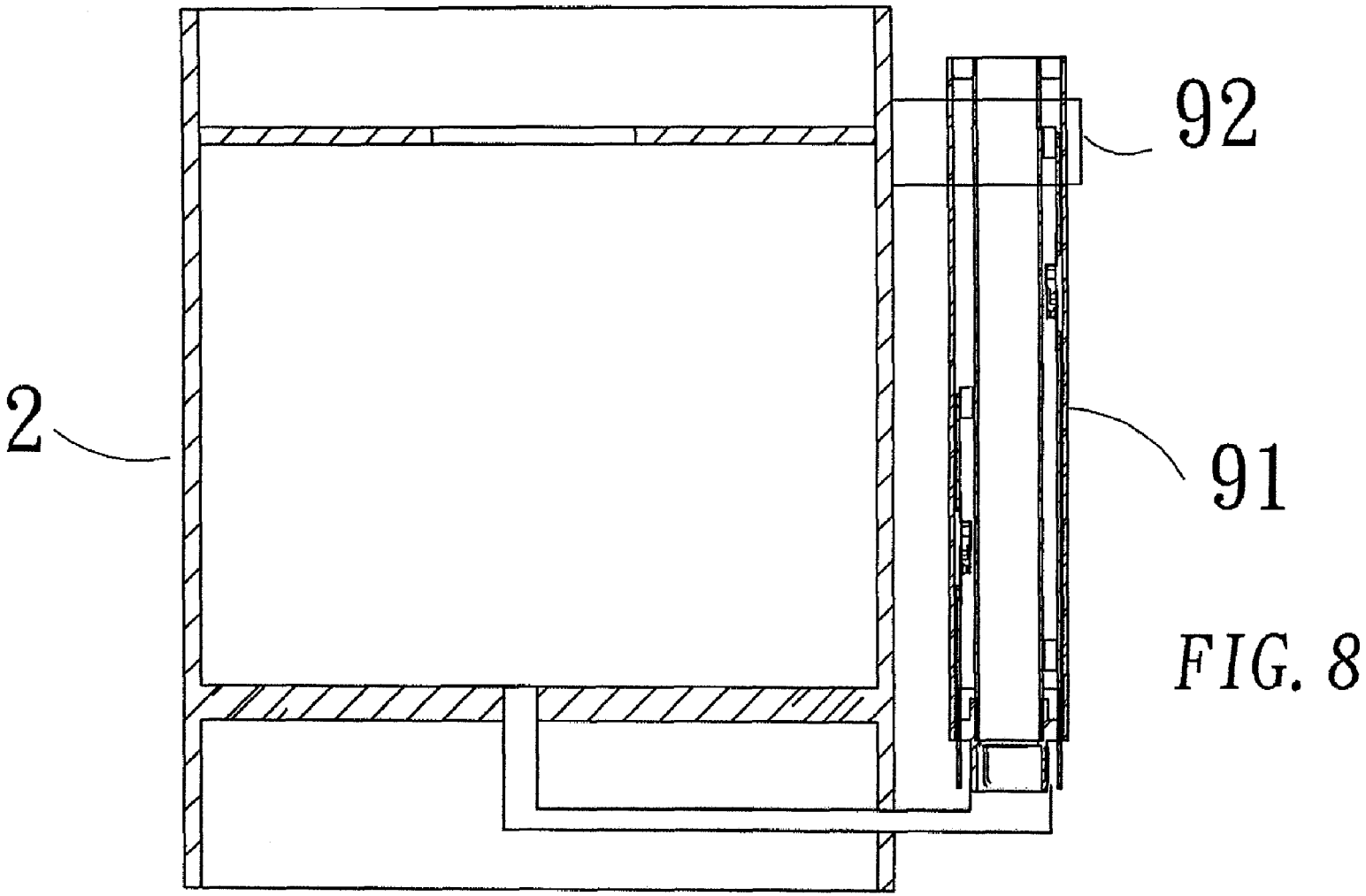
FIG. 8 is a view showing the third embodiment of the present invention.

Referring to another embodiment of the humidification apparatus in the present invention in FIG. 8, the quartz heating tubes used in the present invention not only can be disposed in the internal part of said reservoir as shown in FIG. 2, but can be disposed in the external part of said reservoir as shown in FIG. 8 where a portable quartz heating tube 91 or a hang device 92 can be hanged in the external part of said reservoir 2.

Figure 9:
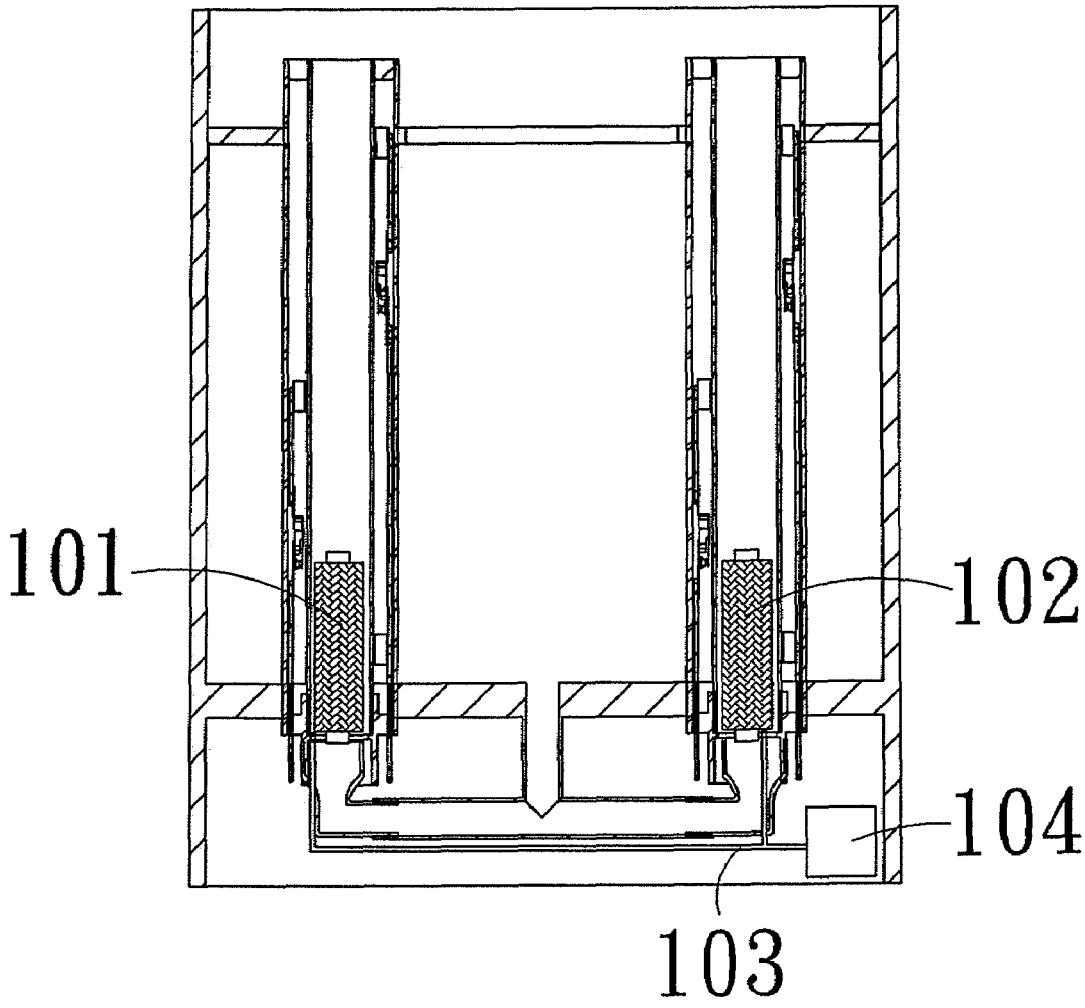
FIG. 9 is a view showing the fourth embodiment of the present invention.

Referring to another embodiment of the humidification apparatus in the present invention in FIG. 9, two boiling suppressors 101, 102 are provided in the internal part of the quartz heating tube. The boiling suppressors 101, 102 can be porous device and may be made of ceramics or other materials. One end of said boiling suppressor is connected to the air pump 104 through pipe 103 where air is pumped into boiling suppressors 101, 102 by the air pump 104. Many air bubbles appear in the liquid, which reduces spurt caused by sudden boiling after heating liquid and improves use safety.

As mentioned above, the humidification apparatus in the present invention certainly has an unprecedented, innovative structure, which is not seen in the conventional decorative lamps. Also, the present invention has not yet been made public, which is consistent with relevant Patent Law.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A humidification apparatus comprising:

a reservoir, a connecting tube and a heating tube having an internal part;

wherein the heating tube introduces liquid from the reservoir through the connecting tube and heats the liquid in the heating tube to generate steam and wherein the internal part of a heating tube includes a porous boiling suppressor for suppressing boiling after the liquid is heated and an airpump connected to the porous boiling suppressor to pump air into the porous boiling suppressor to produce air bubbles to suppress boiling.

2. The humidification apparatus as claimed in claim 1, wherein said boiling suppressor can be made of ceramics.

3. The humidification apparatus as claimed in claim 1, wherein the external surface of said heating tube is covered with an electric film (or an electrothermal film) capable of giving out heat after electrification, and provided with electrodes for connecting the power.

4. The humidification apparatus as claimed in claim 3, wherein said heating tube is a quartz tube.

5. The humidification apparatus as claimed in claim 4, wherein an insulation sleeve is provided in the internal part of said quartz tube in the heating tube; a seal cover is provided between said insulation sleeve and quartz tube to seal for heat insulation.

6. The humidification apparatus as claimed in claim 3, wherein, a temperature sensing switch is provided between two electrodes.

7. The humidification apparatus as claimed in claim 6, wherein more than one temperature sensing switch is disposed on the heating tube for measuring the temperature in different parts of said heating tube respectively.

8. The humidification apparatus as claimed in claim 1, which includes multiple heating tubes and wherein said heating tubes are provided in said reservoir.

9. The humidification apparatus as claimed in claim 8, wherein said heating tubes are provided in the external part of said reservoir.

10. The humidification apparatus as claimed in claim 8, wherein said heating tubes are disposed in proportion to each other in the reservoir.

11. The humidification apparatus as claimed in claim 8, wherein said heating tubes are arranged in a circular shape in the reservoir.

12. The humidification apparatus as claimed in claim 8, wherein there can be more heating tubes.

* * * * *